US010024165B2

(12) United States Patent
Frish

(10) Patent No.: US 10,024,165 B2
(45) Date of Patent: Jul. 17, 2018

(54) DE-OILER BALANCE WEIGHTS FOR TURBOMACHINE ROTORS AND SYSTEMS FOR REMOVING EXCESS OIL FROM TURBOMACHINE ROTORS

(71) Applicant: United Technologies Corporation, Hartford, CT (US)

(72) Inventor: John D. Frish, Ellington, CT (US)

(73) Assignee: United Technologies Corporation, Farmington, CT (US)

( * ) Notice: Subject to any disclaimer, the term of this patent is extended or adjusted under 35 U.S.C. 154(b) by 437 days.

(21) Appl. No.: 14/947,929

(22) Filed: Nov. 20, 2015

(65) Prior Publication Data

US 2017/0145826 A1 May 25, 2017

(51) Int. Cl.

| | |
|---|---|
| ***F01D 5/02*** | (2006.01) |
| ***F01D 5/10*** | (2006.01) |
| ***F01D 25/32*** | (2006.01) |
| ***F04D 29/32*** | (2006.01) |
| ***F04D 29/66*** | (2006.01) |

(52) U.S. Cl.

CPC ..... *F01D 5/027* (2013.01); *F01D 5/10* (2013.01); *F01D 25/32* (2013.01); *F04D 29/321* (2013.01); *F04D 29/662* (2013.01); *F05D 2220/32* (2013.01)

(58) Field of Classification Search

CPC ..... F01D 5/00; F01D 5/10; F01D 5/26; F01D 25/04; F01D 25/06; F01D 25/18; F01D 25/32; F04D 29/321; F04D 29/662; F04D 29/701; F05D 2220/32; F05D 2260/15; F05D 2260/602

See application file for complete search history.

(56) References Cited

U.S. PATENT DOCUMENTS

| | | | | |
|---|---|---|---|---|
| 4,879,792 | A * | 11/1989 | O'Connor | F01D 5/027 29/889 |
| 5,018,943 | A * | 5/1991 | Corsmeier | F01D 5/027 416/144 |
| 7,687,968 | B2 * | 3/2010 | Waddell | H02K 1/24 310/216.113 |
| 8,246,305 | B2 * | 8/2012 | Lecuyer | F01D 5/027 416/95 |
| 8,888,458 | B2 * | 11/2014 | Billings | F01D 5/027 416/144 |

FOREIGN PATENT DOCUMENTS

| | | | |
|---|---|---|---|
| CN | 204357784 U | * | 5/2015 |
| RU | 2188339 C2 | * | 8/2002 |

* cited by examiner

*Primary Examiner* — Igor Kershteyn

*Assistant Examiner* — Brian P Wolcott

(74) *Attorney, Agent, or Firm* — Snell & Wilmer L.L.P.

(57) ABSTRACT

A de-oiler balance weight for a rotor disk stack susceptible to collecting oil is provided. The rotor disk stack is configured for use in a gas turbine engine. The de-oiler balance weight comprises a front wall having a first mounting aperture and a first outboard end. An aft wall has a second mounting aperture and a second outboard end. An inboard wall connects the front wall and the aft wall and defines a recess therebetween that is configured to receive a flange portion of a rotor disk in the rotor disk stack. A channel extends at least partially through the de-oiler balance weight for directing the oil away from the rotor disk stack.

19 Claims, 4 Drawing Sheets

DE-OILER BALANCE WEIGHTS FOR TURBOMACHINE ROTORS AND SYSTEMS FOR REMOVING EXCESS OIL FROM TURBOMACHINE ROTORS

FIELD

The present disclosure relates to gas turbine engines, and more specifically, to de-oiler balance weights for turbomachine rotors, and systems for removing excess oil from turbomachine rotors.

BACKGROUND

Conventional gas turbine engines comprise a compressor section and a turbine section. The compressor section may include a low pressure compressor and a high pressure compressor. The turbine section may include a low pressure turbine and a high pressure turbine. The rotating portions of the compressors and turbines form rotors comprising one or more rotor disks coupled to each other to form a rotor disk stack. As the rotor disk stack rotates within the gas turbine engine at high speeds, the rotor may be rotationally balanced to reduce vibration. At least one rotor disk in the rotor disk stack may include a flange portion to which one or more balance weights is coupled, thereby balancing the rotor disk stack. However, the rotor disk stack may be subject to oil collection due to its proximity to a bearing compartment within the gas turbine engine. Oil collection by the rotor disk stack is desirably minimized for fire safety.

Conventional methods for minimizing oil collection in and around the rotor disk stack have included incorporating a drain hole into the flange portion thereof or scalloping the flange portion with curved notches, but these conventional methods may structurally weaken the rotor disk stack.

SUMMARY

A de-oiler balance weight is provided for a rotor disk stack susceptible to collecting oil, according to various embodiments. The rotor disk stack is configured for use in a gas turbine engine. The de-oiler balance weight comprises a front wall having a first mounting aperture and a first outboard end. An aft wall has a second mounting aperture and a second outboard end. An inboard wall connects the front wall and the aft wall and defines a recess therebetween that is configured to receive a flange portion of a rotor disk in the rotor disk stack. A channel extends at least partially through the de-oiler balance weight for directing the oil away from the rotor disk stack.

A rotor disk stack in a gas turbine engine is provided according to various embodiments. The rotor disk stack is susceptible to collecting oil. The rotor disk stack comprises a rotor disk having a flange portion and a de-oiler balance weight mounted to the flange portion. The de-oiler balance weight has a channel that extends at least partially therethrough for directing the oil away from the rotor disk stack.

A system is provided for removing oil from a rotor disk stack in a gas turbine engine according to various embodiments. The system comprises a rotor disk in the rotor disk stack. The rotor disk has a flange portion comprising a forward face, an aft face, an inboard end, and an axial hole between the forward face and the aft face. A de-oiler balance weight has a first mounting aperture and a second mounting aperture. The de-oiler balance weight is mounted to the flange portion and comprises a channel for directing the oil away from the rotor disk stack. A fastener extends through the first mounting aperture and the second mounting aperture and through the axial hole.

In any of the foregoing embodiments, the de-oiler balance weight has at least one of a generally U-shaped body or a generally J-shaped body in longitudinal cross-section. The channel extends from a channel inlet at the second outboard end, through the aft wall and the inboard wall to a channel outlet at a terminal end of the inboard wall. The channel comprises at least one of an internal channel that extends through an interior portion of the de-oiler balance weight or an external channel that extends through an external surface of the de-oiler balance weight. The de-oiler balance weight is configured to be mounted to the flange portion by an attachment rivet extending through the first and second mounting apertures and an axial hole in the flange portion. The rotor disk stack is located in at least one of a compressor section or a turbine section of the gas turbine engine. The second outboard end extends at an angle inclined radially outwardly and away from a circumferential center of the de-oiler balance weight. The oil is directed away from the rotor disk stack during acceleration and deceleration of the gas turbine engine.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the inventions, it should be understood that other embodiments may be realized and that logical changes and adaptations in design and construction may be made in accordance with the present inventions and the teachings herein. Thus, the detailed description herein is presented for purposes of illustration only and not of limitation. The scope of the present inventions is defined by the appended claims. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Various embodiments are directed to de-oiler balance weights for turbomachine rotors, and systems for removing oil from turbomachine rotors (more particularly, the rotor disk stacks thereof). The rotors in gas turbine engines (i.e., turbomachine rotors) are rotationally balanced against vibration using one or more balance weights coupled to a rotor disk of a rotor disk stack in the rotor. According to various embodiments, the one or more balance weights include features for directing oil away from the rotor. The oil may be displaced from oil bearings proximate the rotor, and may disadvantageously collect in the rotor, thereby presenting fire safety concerns. Various embodiments may be utilized in new aircraft engine designs or in retrofitted aircraft engines. As used herein, "aft" refers to the direction associated with the tail of the aircraft, or generally, to the direction of exhaust of the gas turbine engine. As used herein, "forward" or "front" refers to the direction associated with the nose of the aircraft, or generally, to the direction of flight.

Figure 1:
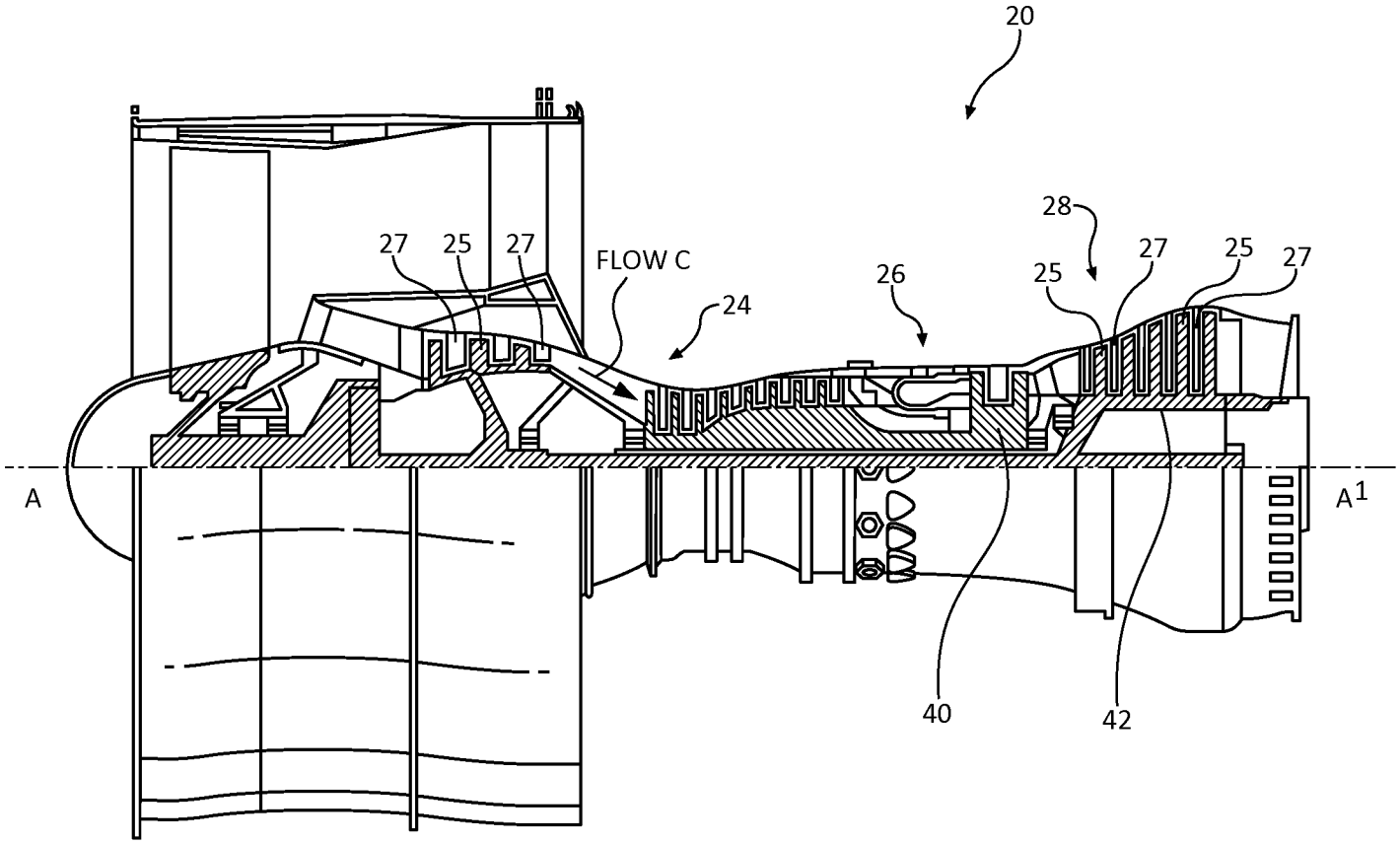
FIG. 1 is a perspective view of an exemplary aircraft gas turbine engine in accordance with various embodiments.

With initial reference to FIG. 1, an aircraft gas turbine engine is illustrated. In general terms, the gas turbine engine 20 may comprise a compressor section 24. Air may flow through compressor section 24 and into a combustion section 26, where it is mixed with a fuel source and ignited to produce hot combustion gas. The hot combustion gas may drive a series of turbine blades within a turbine section 28, which in turn drive, for example, one or more compressor section blades mechanically coupled thereto.

Each of the compressor section 24 and the turbine section 28 may include alternating rows of rotor assemblies and vane assemblies (shown schematically) that carry airfoils that extend into the core flow path C. For example, the rotor assemblies may carry a plurality of rotating blades 25, while each vane assembly may carry a plurality of vanes 27 that extend into the core flow path C. The blades 25 add or extract energy (in the form of pressure) from the core airflow that is communicated through the gas turbine engine 20 along the core flow path C. The vanes 27 direct the core airflow to the blades 25 to either add or extract energy.

Turbine section 28 may comprise, for example, a turbine rotor 40. In various embodiments, high pressure turbine section 40 may comprise a turbine rotor comprising a rotor disk stack 42. Rotor disk stack 42 may, for example, comprise one or more blades 25 coupled to each other and configured to rotate about axis A-A'. While various embodiments are described with reference to a turbine rotor in a turbine section of the gas turbine engine, it is to be understood that the turbomachine rotor may be located in the compressor section of the gas turbine engine.

Figure 2:
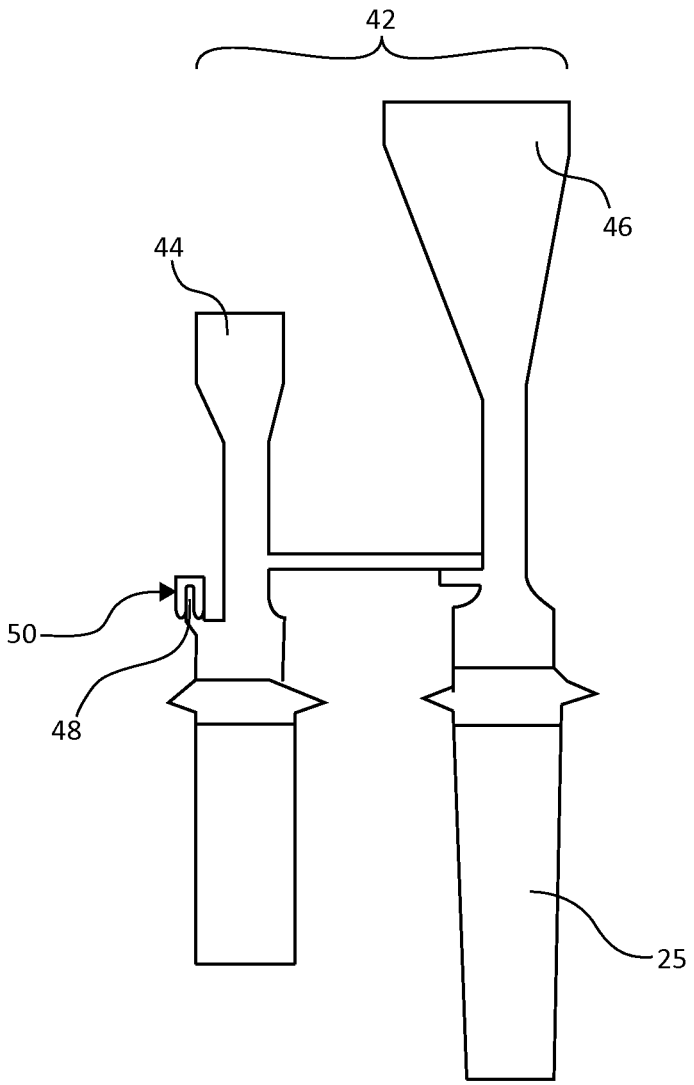
FIG. 2 is a cross-sectional view of a portion of an exemplary rotor of the gas turbine engine (e.g. a turbine rotor) of FIG. 1, illustrating a rotor disk stack including an exemplary pair of rotor disks, one of the rotor disks having a de-oiler balance weight mounted on a flange portion of the rotor disk in accordance with various embodiments.

Referring now to FIG. 2, according to various embodiments, the depicted turbine rotor comprises a rotor disk stack 42 comprising a first rotor disk 44 and a second rotor disk 46. Each of the first rotor disk 44 and the second rotor disk 46 comprises one or more blades 25. While the depicted rotor disk stack comprises two rotor disks, it is to be understood that the rotor disk stack may comprise any number of rotor disks, including a single rotor disk.

Still referring to FIG. 2 and now to FIGS. 3 and 4, the rotor disk stack 42 may comprise a flange portion 48 for mounting one or more de-oiler balance weights 50, according to various embodiments, as hereinafter described. For example, the first rotor disk 44 may comprise the flange portion 48. The flange portion 48 has a forward surface/face 52 (FIGS. 3B and 4B) and an aft surface/face 54 (FIGS. 3B and 4B) between which one or more axial holes 56 (FIGS. 3B and 4B) extend.

Still referring to FIG. 2 and now more particularly to FIGS. 3A through C and 4A through 4C, according to various embodiments, a de-oiler balance weight 50 may be mounted at one or more of the axial holes 56. The flange portion 48 is shown proximate a front mating face 58 of the first rotor disk 44. The front mating face 58 of the first rotor disk 44 and the flange portion 48 define an oil collection recess 59 that undesirably receives and collects oil 61 from proximate oil bearing compartments. The flange portion 48 comprises the one or more axial holes 56 (only one illustrated) spaced circumferentially along the flange portion, passing through the body of the flange portion from the forward surface/face 52 to the aft surface/face 54. The axial holes are shaped and sized to receive a fastener such as an attachment rivet 60 for mounting the one or more de-oiler balance weights 50 to the flange portion 48 of the rotor disk in the rotor disk stack 42 according to various embodiments.

In various embodiments, the one or more de-oiler balance weights 50 are configured to provide vibrational balancing to the rotor. Each of the one or more de-oiler balance weights 50 is mounted to the flange portion 48 by the attachment rivet 60. Mounting apertures in the de-oiler balance weight 50 may be aligned with one of the axial holes in the flange portion and the attachment rivet passed axially through the axial hole in the flange portion and the mounting apertures in the de-oiler balance weight as shown, for example, in FIGS. 3A through 3C and FIGS. 4A through 4C. De-oiler balance weights 50 may be added or removed until vibrational balancing is provided to the rotor during engine operation. The mounting of the one or more de-oiler balance weights 50 to at least one rotor disk in the rotor disk stack may be performed outside of the gas turbine engine, for example, on a balancing machine, before installing the balanced rotor within the gas turbine engine 20.

Still referring to FIG. 2 and to FIGS. 3A through 4C, according to various embodiments, the de-oiler balance weight 50 may be generally U-shaped in cross section as illustrated in FIG. 2 or generally J-shaped in longitudinal cross-section as shown in FIGS. 3A through 4C. The de-oiler balance weight 50 comprises a front wall 64 and an aft wall 62. An axially-extending inboard wall 66 connects the aft and front walls, 62 and 64, and defines a recess 68 therebetween that is configured for receiving the flange portion 48 of the rotor disk in the rotor disk stack. The front wall 64 and the aft wall 62 have respective outboard ends. More specifically, the front wall 64 has a first outboard end 69 and the aft wall 62 has a second outboard end 70 that extends at an angle inclined radially outwardly and away from a circumferential center of the de-oiler balance weight. The second outboard end 70 generally has a shovel shape to pick up and direct the oil from the oil collection recess into a channel 78*a*/78*b* of the de-oiler balance weight as hereinafter described. As used herein, the term "shovel shape" and "shovel shaped" means shaped like a curved blade or scoop. The curved blade or scoop may be slightly curved with upturned edges. The second outboard end may have a flare (incline) for scooping the oil. The second outboard end 70 extends into the oil collection recess 59 as depicted in FIGS. 3B and 4B. The inboard wall 66 has an inner surface 74 along the recess 68 (forming a base of the recess). The aft and front walls 62 and 64 have respective mounting apertures 76*a* and 76*b* therethrough. More specifically, the front wall 64 has a first mounting aperture 76*a* and the aft wall 62 has a second mounting aperture 76*b*. As noted previously, the attachment rivet 60 extends through the mounting apertures 76*a* and 76*b* and the axial hole 56 in the flange portion 48 to mount the de-oiler balance weight 50 to the flange portion 48.

Still referring to FIGS. 3A through 4C, according to various embodiments, the de-oiler balance weight 50 further comprises the channel 78*a* or 78*b* extending partially or completely through the de-oiler balance weight 50 for directing excess oil away from the rotor disk stack. The channel may extend from a channel inlet 80 at the second outboard end 70, through the aft wall 62 and the inboard wall 66 to a channel outlet 82 at a terminal end of the inboard wall 66. The channel inlet 80 may be shovel-shaped to pick up and direct the oil 61 from the oil collection recess 59 into the channel.

Figure 3A:
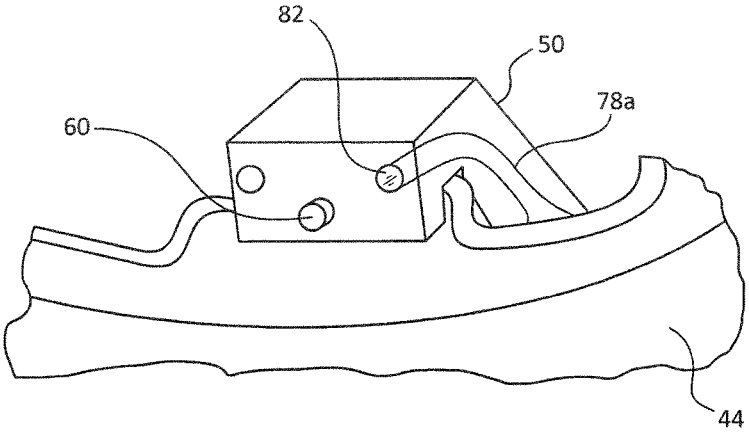
FIGS. 3A through 3C are different views of a portion of the rotor disk in the rotor disk stack of FIG. 2, illustrating the de-oiler balance weight comprising external channels to direct oil away from the rotor disk stack.
Figure 3B:
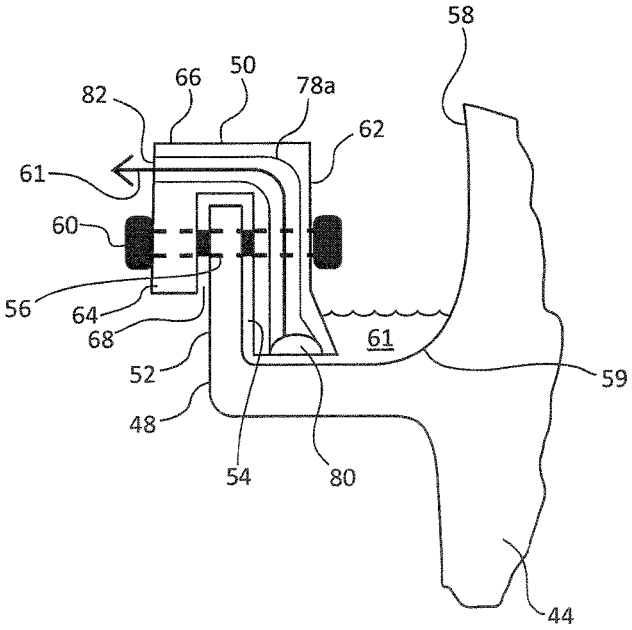
Figure 3C:
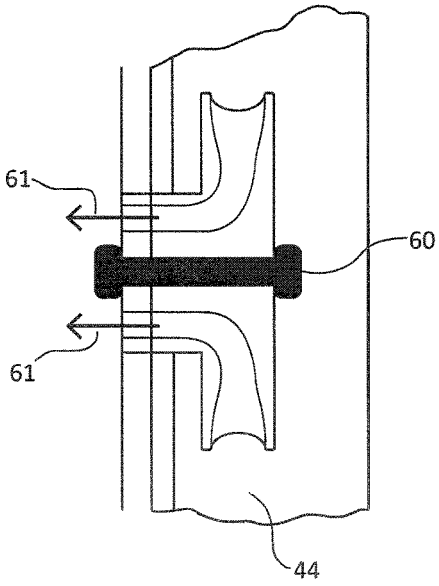
Figure 4A:
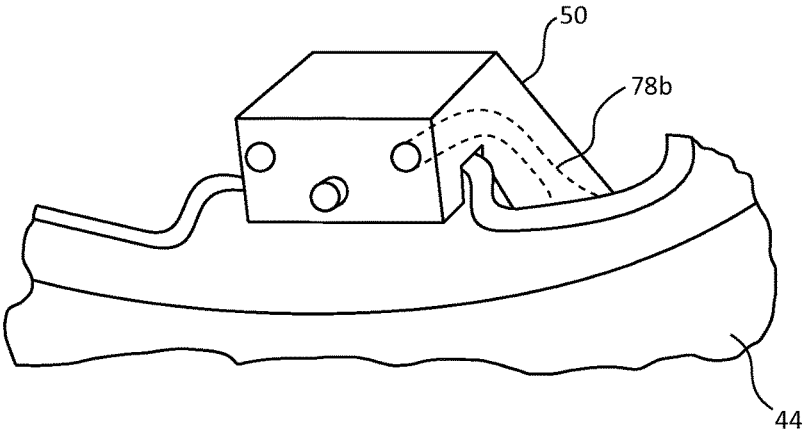
FIGS. 4A through 4C are similar views to FIGS. 3A through 3C, illustrating the de-oiler balance weight comprising internal channels (depicted by dotted lines) to direct oil away from the rotor disk stack.
Figure 4B:
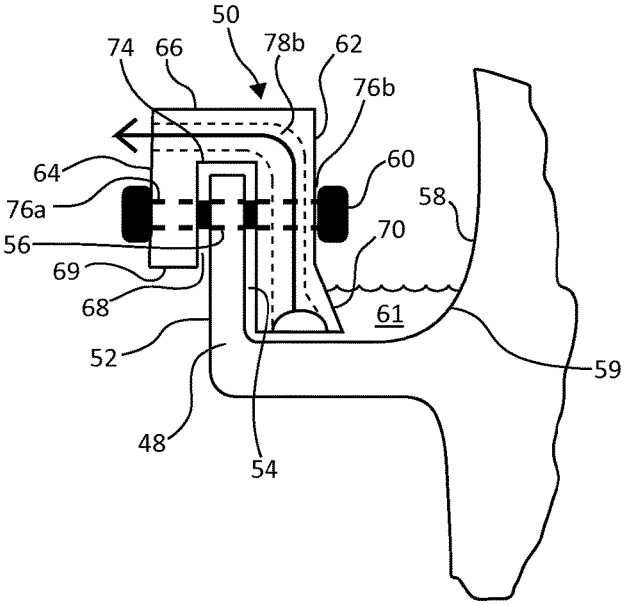
Figure 4C:
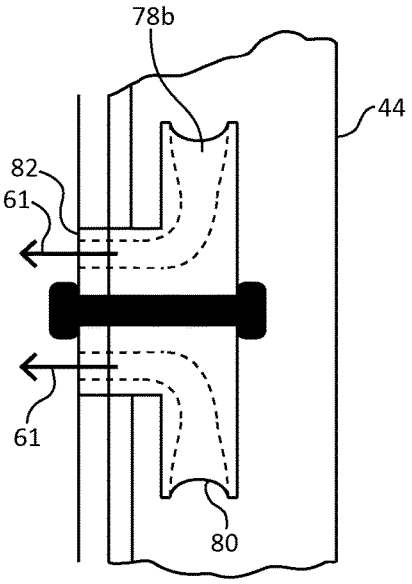

Referring now specifically to FIGS. 3A through 3C and to FIGS. 4A through 4C, according to various embodiments, the channel may comprise an external channel 78*a* that partially extends through the de-oiler balance weight 50 in an external surface thereof (FIGS. 3A through 3C). A channel comprising an internal channel 78*b* may partially or completely extend through an interior portion of the de-oiler balance weight as shown by dotted lines in FIGS. 4A through 4C. The de-oiler balance weight may be manufactured by known methods, including by additive manufacturing. In various embodiments, a combination of the external channel 78*a* and an internal channel 78*b* may be used in the de-oiler balance weight 50.

While a single de-oiler balance weight coupled to the first rotor disk of rotor disk stack is illustrated in FIG. 2, it is to be understood that additional de-oiler balance weights may be coupled to one or more additional rotor disks in the rotor disk stack such as, for example, second rotor disk of the rotor disk stack of FIG. 2. The additional rotor disks may comprise the same features as the first rotor disk (e.g., the flange portion) to mount the de-oiler balance weight thereto which functions to vibrationally balance the rotor and direct excess oil therefrom in accordance with various embodiments. The de-oiler balance weight may be coupled to any rotor disk in the rotor disk stack in order to balance the rotor. It is also to be understood that the one or more de-oiler balance weights may be coupled to a flange portion located at a different location of the rotor disk.

In use, a user may have access to a number of different sizes (masses) of the de-oiler balance weights 50 dimensioned for use with a given flange portion. A computer spin balancing method may involve the computer controlling rotation of the rotor on a balancing machine and measuring vibratory forces. Based on the measured forces, the computer may determine where to put one or more de-oiler weights 50 of given mass(es) at given flange portion locations. The user does this and rivets the de-oiler balance weight(s) 50 to the flange portion(s) 48 where indicated. Thus, one or more of the flange portions 48 may have de-oiler balance weights 50 mounted thereto and the de-oiler balance weights may have different masses.

In operation, the oil and the rotor disk stack rotate at different angular velocities during engine acceleration and decelerations (e.g., during takeoff, landing, or any time that the gas turbine engine experiences a change in revolutions in minute (rpm), resulting in a disparity between the angular velocity of the oil and the angular velocity of the rotor disk stack (including the de-oiler balance weight(s) 50). The excess oil is directed into passages 78*a* and 78*b* by the angular velocity disparity and away from the rotor (more particularly, the rotor disk stack) (i.e., removed through the channel of the de-oiler balance weight 50) when the gas turbine engine 20 accelerates or decelerates.

Benefits, other advantages, and solutions to problems have been described herein with regard to specific embodiments. Furthermore, the connecting lines shown in the various figures contained herein are intended to represent exemplary functional relationships and/or physical mountings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A de-oiler balance weight for a rotor disk stack susceptible to collecting oil, the rotor disk stack configured for use in a gas turbine engine, the de-oiler balance weight comprising:

a front wall having a first mounting aperture and a first outboard end;

an aft wall having a second mounting aperture and a second outboard end;

an inboard wall connecting the front wall and the aft wall and defining a recess therebetween that is configured to receive a flange portion of a rotor disk in the rotor disk stack; and a channel extending at least partially or completely through the de-oiler balance weight for directing the oil away from the rotor disk stack.

2. The de-oiler balance weight of claim 1, wherein the de-oiler balance weight has at least one of a generally U-shaped body or a generally J-shaped body in longitudinal cross-section.

3. The de-oiler balance weight of claim 1, wherein the channel extends from a channel inlet at the second outboard end, through the aft wall and the inboard wall to a channel outlet at a terminal end of the inboard wall.

4. The de-oiler balance weight of claim 1, wherein the channel comprises at least one of an internal channel that extends through an interior portion of the de-oiler balance weight or an external channel that extends through an external surface of the de-oiler balance weight.

5. The de-oiler balance weight of claim 1, wherein the de-oiler balance weight is configured to be mounted to the flange portion by an attachment rivet extending through the first and second mounting apertures and an axial hole in the flange portion.

6. The de-oiler balance weight of claim 1, wherein the rotor disk stack is located in at least one of a compressor section or a turbine section of the gas turbine engine.

7. The de-oiler balance weight of claim 1, wherein the second outboard end extends at an angle inclined radially outwardly and away from a circumferential center of the de-oiler balance weight.

8. The de-oiler balance weight of claim 1, wherein the oil is directed away from the rotor disk stack during acceleration and deceleration of the gas turbine engine.

9. A rotor disk stack in a gas turbine engine, the rotor disk stack susceptible to collecting oil and comprising:

a rotor disk having a flange portion; and a de-oiler balance weight mounted to the flange portion, the de-oiler balance weight having a channel that extends at least partially therethrough for directing the oil away from the rotor disk stack, wherein the de-oiler balance weight comprises:

a front wall having a first mounting aperture and a first outboard end;

an aft wall having a second mounting aperture and a second outboard end;

an inboard wall connecting the front wall and the aft wall and defining a recess therebetween that is configured to receive the flange portion of the rotor disk in the rotor disk stack; and the channel.

10. The rotor disk stack of claim 9, wherein the second outboard end extends at an angle inclined radially outwardly and away from a circumferential center of the de-oiler balance weight.

11. The rotor disk stack of claim 9, wherein the de-oiler balance weight has at least one of a generally U-shaped body or a generally J-shaped body in longitudinal cross-section.

12. The rotor disk stack of claim 9, wherein the channel extends from a channel inlet at the second outboard end, through the aft wall and the inboard wall to a channel outlet at a terminal end of the inboard wall.

13. The rotor disk stack of claim 9, wherein the channel comprises at least one of an internal channel that extends through an interior portion of the de-oiler balance weight or an external channel that extends through an external surface of the de-oiler balance weight.

14. The rotor disk stack of claim 9, wherein the de-oiler balance weight is configured to be mounted to the flange portion by an attachment rivet extending through the first and second mounting apertures and an axial hole in the flange portion.

15. The rotor disk stack of claim 9, wherein the oil is directed away from the rotor disk stack during acceleration and deceleration of the gas turbine engine.

16. A system for removing oil from a rotor disk stack in a gas turbine engine, the system comprising:

a rotor disk in the rotor disk stack, the rotor disk having a flange portion comprising:

a forward face;

an aft face;

an outboard end;

an axial hole between the forward face and the aft face;

a de-oiler balance weight having a first mounting aperture and a second mounting aperture, the de-oiler balance weight mounted to the flange portion and comprising a channel for directing the oil away from the rotor disk stack; and a fastener extending through the first mounting aperture and the second mounting aperture and through the axial hole.

17. The system of claim 16, wherein the de-oiler balance weight comprises:

a front wall having the first mounting aperture and a first outboard end;

an aft wall having the second mounting aperture and a second outboard end;

an inboard wall connecting the front wall and the aft wall and defining a recess therebetween that is configured to receive the flange portion of the rotor disk in the rotor disk stack; and the channel that extends at least partially through the de-oiler balance weight.

18. The system of claim 16, wherein the oil is directed away from the rotor disk stack during acceleration and deceleration of the gas turbine engine.

19. The system of claim 17, wherein the second outboard end extends at an angle inclined radially outwardly and away from a circumferential center of the de-oiler balance weight.

* * * * *